US009556755B2

(12) United States Patent
Dupke et al.

(10) Patent No.: US 9,556,755 B2
(45) Date of Patent: Jan. 31, 2017

(54) CAM FOLLOWER FOR A VALVE TRAIN OF AN INTERNAL COMBUSTION ENGINE

(71) Applicant: Schaeffler Technologies AG & Co. KG, Herzogenaurach (DE)

(72) Inventors: Stefan Dupke, Kodnitz (DE); Michael Schewe, Herzogenaurach (DE); Peter Sailer, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/770,966

(22) PCT Filed: Jan. 20, 2014

(86) PCT No.: PCT/DE2014/200008
§ 371 (c)(1),
(2) Date: Aug. 27, 2015

(87) PCT Pub. No.: WO2014/135159
PCT Pub. Date: Sep. 12, 2014

(65) Prior Publication Data

US 2016/0010514 A1 Jan. 14, 2016

(30) Foreign Application Priority Data

Mar. 8, 2013 (DE) ..... 10 2013 203 956

(51) Int. Cl.
*F01L 1/34* (2006.01)
*F01L 1/18* (2006.01)
(Continued)

(52) U.S. Cl.
CPC ..... *F01L 1/181* (2013.01); *B21D 35/001* (2013.01); *B21D 53/84* (2013.01); *B21K 1/205* (2013.01);
(Continued)

(58) Field of Classification Search
CPC ..... F01L 1/181; F01L 1/46; B21D 35/001
(Continued)

(56) References Cited

U.S. PATENT DOCUMENTS

| | | | |
|---|---|---|---|
| 5,016,582 | A | 5/1991 | Mills |
| 5,720,245 | A | 2/1998 | Calka |

FOREIGN PATENT DOCUMENTS

| | | |
|---|---|---|
| DE | 4133033 | 4/1992 |
| EP | 1122408 | 8/2001 |
| JP | 200024048 | 9/2000 |

*Primary Examiner* — Zelalem Eshete
(74) *Attorney, Agent, or Firm* — Volpe and Koenig, P.C.

(57) ABSTRACT

A cam follower for a valve train of an internal combustion engine, the cam follower being formed as a lever, which is U-shaped in cross-section, and produced from steel sheet without machining, and which has a floor wall (3) and lateral walls (4 and 5) extending therefrom, wherein a valve stem support (10) is disposed as a groove (11) at one end of the lever in a surface of the floor wall (3) facing away from the lateral walls (4 and 5). Lateral guide walls (12 and 13) of the valve stem support (10) are formed by chipless shaping so as to extend from and counter to the lateral walls (4 and 5) and are connected to a support wall (14) that forms a valve stem support surface (10*a*). The valve stem support surface (10*a*) extends in a first plane (10*b*), which is spaced from a second plane (16*a*), which extends through an internal transition (15, 16) between the lateral walls (4 and 5) and the adjacent guide walls (12 and 13), in the direction of ends (19, 20) of the lateral walls (4 and 5). In order to reduce stress and resulting cracks, an inner radius R is provided at the transition (15 and 16), by which radius a free space (17, 18) is created between the lateral wall (4, 5) and the guide wall (12, 13), which free space narrows towards the end (19, 20) of the respective lateral wall (4, 5).

7 Claims, 2 Drawing Sheets

(51) Int. Cl.

| | |
|---|---|
| ***B21K 1/20*** | (2006.01) |
| ***B21K 23/00*** | (2006.01) |
| ***B21D 53/84*** | (2006.01) |
| ***B21D 35/00*** | (2006.01) |
| ***F01L 1/46*** | (2006.01) |

(52) U.S. Cl.
CPC ..... *B21K 23/00* (2013.01); *F01L 1/185* (2013.01); *F01L 1/46* (2013.01)

(58) Field of Classification Search
USPC ..... 123/90.16
See application file for complete search history.

CAM FOLLOWER FOR A VALVE TRAIN OF AN INTERNAL COMBUSTION ENGINE

FIELD OF THE INVENTION

Background

The invention relates to a cam follower for a valve train of an internal combustion engine, wherein this cam follower is constructed as a lever that is produced with a U-shape, viewed in cross section, from sheet steel in a non-cutting process and has a base wall and side walls projecting from this base wall, wherein, on one end of the lever, in a surface of the base wall turned away from the side walls, a valve stem support formed as a groove is provided whose side guiding walls are formed by a non-cutting shaping process, in opposite directions starting from the side walls, and are connected to a support wall forming a valve support surface, wherein the valve support surface extends in a first plane that is spaced apart from a second plane extending through an inner transition between the side walls and the adjacent guiding walls in the direction of ends of the side walls.

The invention further also relates to a method for the non-cutting production of a cam follower formed as a lever from sheet steel, wherein this lever is provided for a valve train of an internal combustion engine and has essentially a U-shaped cross section with a base wall and side walls extending essentially perpendicular to this base wall, wherein a valve stem support provided on one end of the lever is formed in the base wall as a groove whose side guiding walls are formed by a non-cutting shaping process, in opposite directions starting from the side walls, and are connected to a support wall forming a valve support surface, wherein this valve support surface extends in a first plane that is spaced apart from a second plane extending through an inner transition between the side walls and the adjacent guide walls in the direction of ends of the side walls.

Cam followers are used in valve trains of internal combustion engines to transfer, as part of the valve control, the cam lift of a cam of a camshaft to the corresponding gas exchange valve formed as an intake or exhaust valve, so that the gas exchange valve is moved against a valve spring into its open position due to this valve lift. The cam followers can be formed as, among other things, rocker arms, oscillating arms, or tilting arms, wherein they are usually formed as sheet-metal parts using non-cutting methods or as precision cast parts. The designation rocker arm or finger lever is used generally for one-arm levers, wherein, for the case of the rocker arms, one end is supported by a dome provided on this end by a support element on the cylinder head of the internal combustion engine, while for oscillating arms, the corresponding end is supported on an oscillating arm axis. Both lever types are used for valve trains with overhead camshafts, wherein the individual cams preferably contact the lever by cam rollers provided centrally in the lever.

Accordingly, rocker arms are formed as two-arm levers, i.e., the rocker arms have a rocker arm axis in the area of its center, wherein they can be used both for valve trains with underhead camshafts and also for valve trains with overhead camshafts. In a valve train with underhead camshafts, a tappet rod contacts one end of the rocker arm, while for a drive by an overhead camshaft, this contacts directly on the end of the rocker arm or similarly via a cam roller on this end.

Levers made from sheet metal in non-cutting processes are usually formed with a U-shaped profile, viewed in cross section. Here, these U-shaped sheet-metal levers are formed and arranged within the valve train so that the lever engages a valve stem end of the gas exchange valve with its U-shaped profile. To achieve a very compact valve train and to improve the stiffness of the lever, however, sheet-metal levers according to the class are used that are turned away from the valve stem end with the open section of their U-shaped form, so that a valve stem support must be formed on their base wall.

A cam follower of the class described in the preamble of independent is known from DE 41 33 033 C2. The corresponding rocker arm has, in this case, also a U-shaped cross section, wherein the area of the valve stem support is formed as a groove formed in the base wall of the U-profile. In this way, on both sides of the groove, parallel wall sections are formed by side walls of the lever and by guiding walls of the groove that are formed in opposite directions. A corresponding groove-like formation is produced by an indentation or extrusion pressing process. The groove for the valve stem support is here formed with a relatively large depth, i.e., the valve support surface is in a first plane that is spaced apart to a second plane extending through an inner transition between the side walls and the adjacent guiding walls in the direction of ends of the side walls. This leads to crimped fold formations that cause problems in terms of durability during operation in the area of each transition of the side wall to the adjacent guiding wall, which is deformed by 180°. In the previously known solution, the guiding wall is angled relative to the side wall by the previously specified 180°, i.e., after a fold the outer surface of each guide wall is on the inner surface of the side wall. As already mentioned, this angle leads to high stresses at the transition from each side wall to the guiding wall, so that after a relatively short operating period, cracks appear starting from this location of highest stresses.

Furthermore, from U.S. Pat. No. 5,720,245 A, a rocker arm is known that likewise has a U-shaped form and has, on its base wall, a valve stem support formed as a groove. This groove is formed according to that publication by a forming and embossing punch, wherein, in the forming process, material is deformed from the side walls into the base area. This produces a W-shaped profile of the rocker arm in the area of its valve stem support. However, the groove is formed with only a minimal depth, so that the wall sections cannot be doubled in this area.

SUMMARY

The invention is based on the object of forming a cam follower of the specified class formed as a lever with a compact design, i.e., minimal width, and in this way avoiding high stresses and thus the formation of cracks in the area of the transition of the side walls to the guiding walls.

This object is achieved with one or more features of the invention. According to one embodiment, at the transition an inner radius R should be provided through which, between the side wall and guiding wall, a free space is created that narrows in the direction of one end of each side wall. Consequently, the guiding wall and the side wall adjacent to this do not form a contact in the area in which they are connected to each other. Instead they transition one into the other with a relatively large inner radius, so that in this region a crimped fold formation can be effectively prevented. Therefore, the stresses that occur can be reduced so that a crack formation is prevented. This inner radius R has the result that, in this area, a free space is produced, wherein this free space becomes narrower upward under consideration of the normal installation position of the lever, that is, in the direction of the end of each side wall. The stresses that occur and the reducing fractures of the lever in this area could also be prevented in that the side walls and the guiding walls are spaced apart from each other overall so that a relatively large inner radius is produced at the transition. In this way, however, the width of the lever would be considerably increased, which results in a corresponding increase of the installation space. In modern valve trains of internal combustion engines, however, the corresponding installation space for the arrangement of the cam follower is very limited, so that a corresponding widening of the lever is basically not possible. In addition, there would also be the disadvantage that the mass and mass inertial moment of the lever would be increased. The same disadvantages would then also occur if the side walls were tilted for creating a corresponding inner radius, so that the lever in the lower region adjacent to the base wall would be wider than in the area of the ends of the side walls.

In contrast, according to the invention the profile of the side walls relative to the adjacent guiding walls is maintained, that is, the width of the lever is maintained, although the inner radius and the free space are provided in the transition region. The maintained profile of these walls is understood to mean that the guiding surfaces of the guiding walls facing the valve stem end are essentially parallel to the outer surfaces of the side walls facing away from the guiding walls.

In contrast, in DE 41 33 033 C2, the corresponding guiding walls and side walls of the rocker arm shown in that publication form a contact with each other, so that, in the transition region, the previously mentioned crimped fold formation and thus the increased stresses are produced with unavoidable formation of cracks. According to U.S. Pat. No. 5,720,245 A, at the transition from the base wall to the side walls, a relatively large inner radius is provided, but the shown rocker arm has no guiding walls running opposite to the side walls. Instead, for this rocker arm, only a relatively flat groove is provided in the base wall that is produced by an extrusion pressing process. The flat groove does not guarantee sufficient guidance of the lever at the valve stem end. Overall, a correspondingly shaped rocker arm, with respect to the dimensions of the groove provided for holding the valve stem, has an overall relatively wide design in this region, for which the corresponding installation space is not available in modern valve trains.

In another construction of the invention, the inner radius R and the free space are formed as a common indentation in the transition, in the side wall, and in the guiding wall. Thus, the inner radius and the free space that lead to a reduction of the stresses are provided at the transition of each side wall into the guiding wall, without the lever having to have a wider design in this region and consequently the side walls could no longer have to be parallel to each other. A corresponding indentation in the transition, in the side walls, and in the guiding walls is advantageously produced in the still flat sheet metal part before its deformation.

Furthermore, each free space becomes narrower until it contacts the corresponding guiding wall at the respective side wall. The free space consequently forms a point in the direction of the ends of the two side walls until the corresponding guiding wall contacts the adjacent side wall or forms a narrow gap with this wall.

If a corresponding narrow gap is provided between each side wall and the respective guiding wall, then it is further proposed that the free space has at the transition into the inner radius its maximum width that is at least five times the width of the gap at its narrowest point. During the non-cutting shaping process, the material is extruded as a function of the shape of the lever such that, under some circumstances, a flat contact between the adjacent surfaces of the side wall and the guiding wall is produced, which is not important, however, for the present invention, because it involves the formation of the inner radius and the free space. The specified relation of the dimensions of the free space and a gap possibly occurring in certain sections of the surfaces of the walls should clarify that, in the area of the transition between the two walls, a minimum wall distance is provided.

Furthermore, the free space should have a width B≥0.6 mm in the area in which the inner radius R connects, while the inner radius R should be ≥0.3 mm. Here, the free space can have a drop-shaped contour, viewed in the cross section of the lever. As already described, this free space extending in the longitudinal direction of the lever extends with the specified drop-shaped contour such that the apex of the acute angle of this drop shape points in the direction of the ends of the side walls. The lever formed according to the invention should be preferably formed as a rocker arm or oscillating arm provided with a roller pocket for a cam roller. In this case, the free space reaches with the inner radius preferably from the end of the rocker arm or oscillating arm provided with the valve stem support into the area of the roller pocket. On the end facing away from the valve stem support, in a lever formed as the rocker arm, a similarly non-cutting shaped dome is provided by which the rocker arm is supported on a support element mounted in the cylinder head.

The task forming the basis of the invention is also met by the features of a method described herein. According to this method, in a first processing step, a blank is punched out from sheet steel, whereupon, in a second processing step, two grooves with an unfinished part radius $R_R$ are indented in the longitudinal direction of the blank. Then the blank is shaped in a third processing step for producing its U-shape and in a fourth processing step, the groove is indented into the base wall, wherein, on the two grooves, a transition from each of the side walls to the base wall is created that is formed, due to the indented unfinished part radius $R_R$ with an inner radius R and a free space that has a drop-like contour, viewed in cross section of the lever.

In this method according to the invention it is essential that the unfinished part radius $R_R$ is already produced in the blank in the area in which, in the subsequent shaping process, that is, in the formation of the groove, the free space with the inner radius R should be. This process enables more accurate and reliable processing with the production of a lever with low additional manufacturing expense in which, in the transition of the side walls into the guiding walls, the resulting stresses can be reduced so that during the subsequent use of the lever in a valve train of an internal combustion engine, no cracks occur in these areas. Thus, the durability of the lever is significantly improved overall.

The invention is not limited to the specified combination of features described below and in the claims. There is also the ability to combine individual features if they emerge from the claims, the advantageous details to the claims, the subsequent description of the embodiments, or at least from the drawings. The reference in the claims to the drawing through corresponding use of reference symbols does not limit the protective scope of the claims.

BRIEF DESCRIPTION OF THE DRAWINGS

For further explanation of the invention, reference is made to the drawing in which an embodiment is shown simplified. Shown are.

DETAILED DESCRIPTION OF THE PREFERRED EMBODIMENTS

Figure 1:
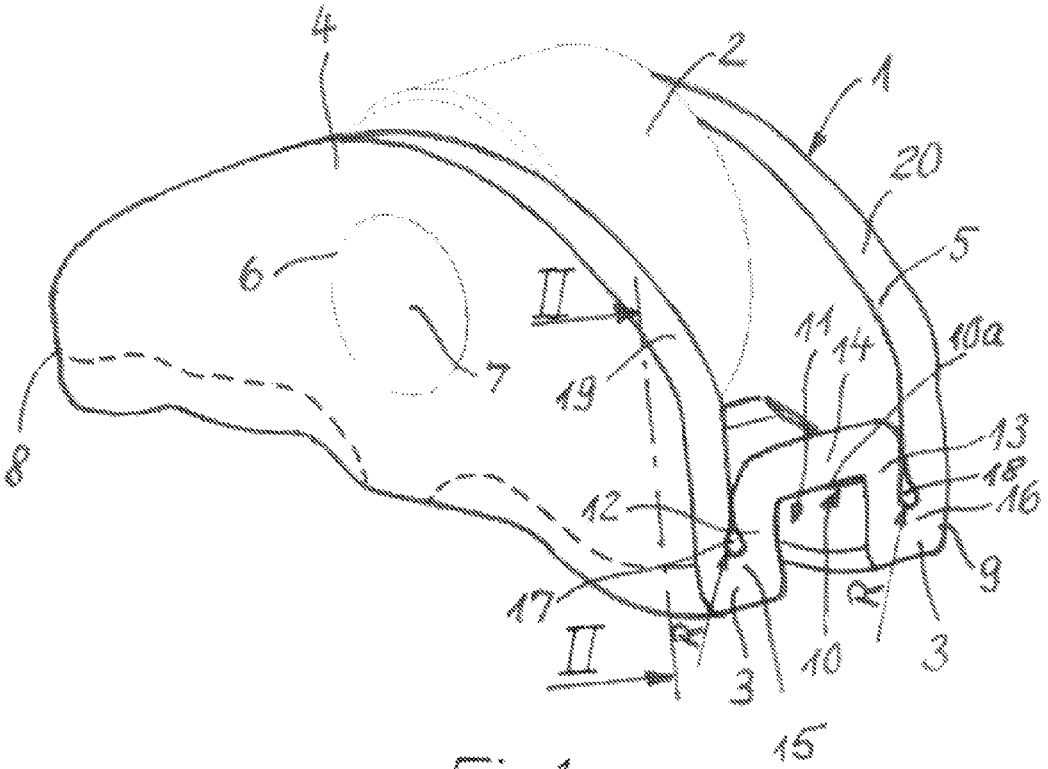
FIG. 1 a perspective view of a rocker arm according to the invention with a cam roller arranged in this arm, FIG. 2 a section through the rocker arm according to FIG. 1 along line II-II, FIG. 3 a perspective representation of a blank punched out from sheet steel for producing a rocker arm according to FIGS. 1 and 2, FIG. 4 a cross section through the blank after the embossing of grooves in its surface, FIG. 5 a perspective view of the rocker arm unfinished part, after which the blank provided with the grooves has been shaped into the U-shape of the rocker arm, and FIG. 6 as a cross section through a rocker arm that shows an enlarged view in the area of a side wall, a guiding wall, and a free space.

In FIG. 1, a rocker arm is designated with 1 that holds a cam roller 2 in the region of its center. Here, the rocker arm 1 has a U-shape design and has a base wall 3 and side walls 4 and 5. In each of the side walls 4 and 5 there is a hole 6, wherein, in these holes 6, of which only one is visible in the figure, a bearing pin 7 is fixed on which the cam roller 2 is supported so that it can rotate by means of a needle bearing not shown in more detail. On a first end 8, the rocker arm 1 has a dome that is not shown in more detail and by which the rocker arm 1 can be guided so that it can pivot on a support element, wherein this not-shown support element that is advantageously provided with a hydraulic valve lash compensation device is mounted on a cylinder head of the internal combustion engine.

A second end 9 of the rocker arm 1 has a valve stem support 10 with a valve stem support surface 10*a*. This valve stem support 10 consists of a groove 11 that is slightly wider than a diameter of the not-shown gas exchange valve to be actuated by the rocker arm. As can be seen in FIG. 1, the groove 11 is produced by means of a non-cutting shaping process in the base wall 3, wherein guiding walls 12 and 13 extend from the base wall 3 and the side walls 4 and 5, respectively, and connect to a support wall 14. For the use of the rocker arm 1 within a valve train of an internal combustion engine, this support wall 14 contacts one end of the valve stem of the corresponding gas exchange valve.

As can be seen in FIG. 1, the two guiding walls 12 and 13 extend essentially parallel to the adjacent side walls 4 and 5. Here, at least one guiding surface of each of the two guiding walls 12 and 13 are arranged essentially parallel to the outer surfaces of the side walls 4 and 5, as still to be explained in connection with FIG. 2. From FIG. 1 it was already described that, in the area of a transition 15 and 16 from each side wall 4 and 5 to the guiding walls 12 and 13, at which these are deformed by 180° relative to each other, free spaces 17 and 18 are provided that each have an inner radius R.

Figure 2:
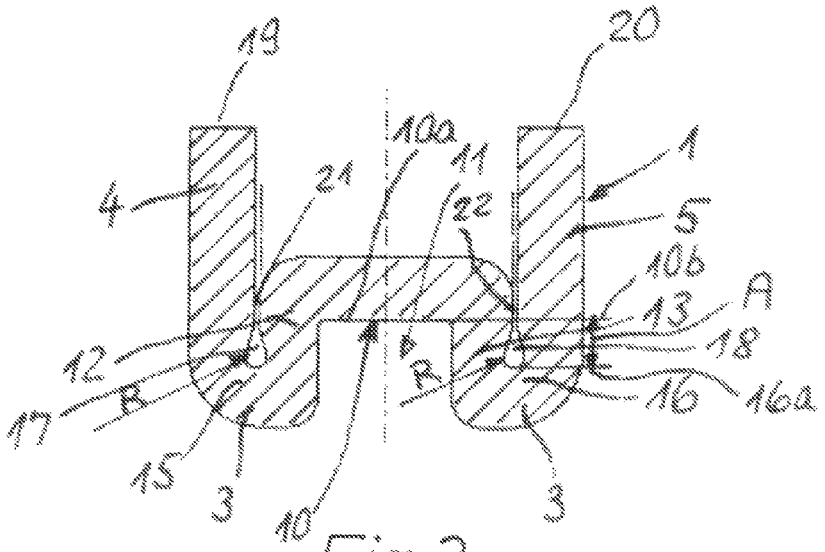

For a more detailed description of the second end 9 of the rocker arm forming the valve stem support 10, refer to FIG. 2, in which a section through the lever 1 in this region is shown. In this figure, the same reference numbers are used as those for the description of FIG. 1. From FIG. 2, it can be seen, first, that between a plane 10*b* set through the valve stem support 10*a*, and a plane 16*a* set through the transition 16, a distance A is provided, so that the lever has a correspondingly large depth of the groove 11. From this figure according to FIG. 2 it is also clearly seen that, in the region of the transitions 15 and 16, between the side walls 4 and 5 and also the guiding walls 12 and 13, free spaces 17 and 18 are formed that, viewed in cross section, have a drop-shaped contour. Here, each free space 17 and 18 are formed in the lower region in which the non-cutting shaping process is performed, with a relatively large inner radius R. Each of these free spaces 17 and 18 extends to a point in the direction of ends 19 and 20 of the side walls 4 and 5, starting from the inner radius R. Here, each free space 17 and 18 transitions into a gap 21 and 22, respectively. Instead of these gaps 21 and 22, the rocker arm 1 can naturally also have a design such that the side walls 4 and 5 contact the guide walls 12 and 13.

Figure 3:
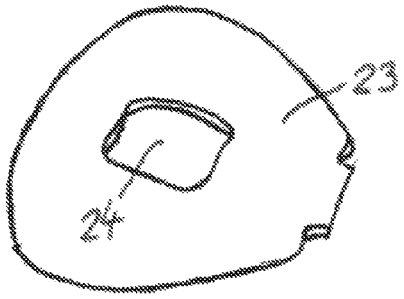
Figure 4:
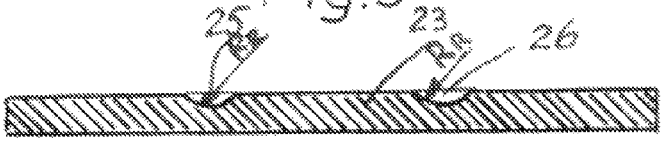
Figure 5:
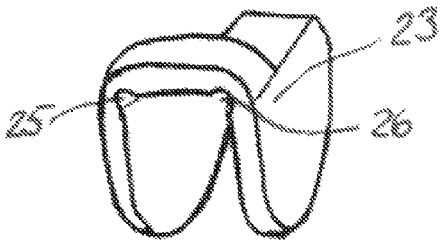

The other FIGS. 3, 4, and 5 show the formation of the blank used for the production of the rocker arm according to FIGS. 1 and 2 in the individual steps of the production process. Here, FIG. 3 shows a blank 23 punched out from sheet steel that already has a pocket 24 for the later holding of the cam roller 2 used according to FIG. 1. According to the invention, two grooves 25 and 26 are embossed with a blank radius $R_R$ in this blank 23 according to FIG. 4, wherein then the blank 23 is shaped into its U-shape. This formation of the blank is shown in FIG. 5 in which the U-shaped blank produced in this way is shown rotated by 180° relative to FIG. 4. In this U-shaped blank, the grooves 25 and 26 are visible, in turn.

Figure 6:
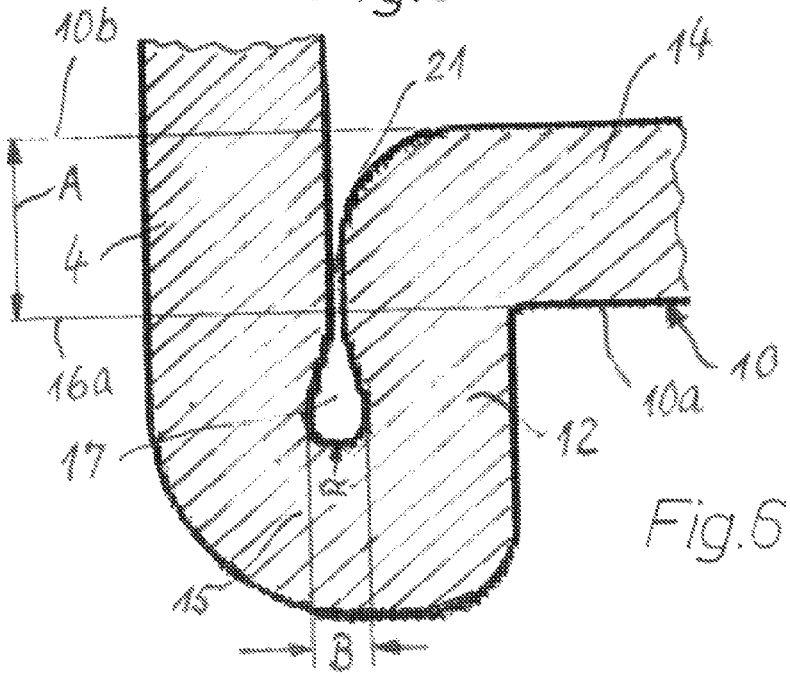

Then the valve stem support 10 is produced in this blank, which happens through an embossing process. Here, the shape of the rocker arm 1 shown according to FIGS. 1, 2, and 6 is produced, wherein this rocker arm is provided with free spaces 17 and 18 and an inner radius R bordering these spaces due to the grooves 25 and 26 provided in the blank. Here, from FIG. 6 it can be seen that the free space 17 has a width B. This should be greater than or equal to 0.6 mm according to the invention. FIG. 6 also shows, in agreement with FIG. 2, the inner radius R, under which the corresponding side wall 4 transitions into the guiding wall 12 and should be greater than or equal to 0.3 mm according to the invention. Finally, this enlarged illustration also shows the two planes 10*b* and 16*a* that should be spaced apart from each other by the dimension A. The plane 10*b* is here adjacent to the two ends 19 and 20 of the side walls 4 and 5, so that the rocker arm is provided with a relatively deep groove 11.

The rocker arm 1 according to the present invention has a high durability, so that the crimped fold formations that occur in the prior art are not produced during the formation of the valve stem support 10 formed as a groove 11 in the region of the transitions 15 and 16 from the side walls 4 and 5 into the guiding walls 12 and 13. Thus, advantageously, the stresses that occur in this region can be minimized so that, according to the invention, the risk of a formation of cracks is significantly reduced.

LIST OF REFERENCE NUMBERS

1 Rocker arm
2 Cam roller
3 Base wall
4 Side wall
5 Side wall
6 Hole
7 Rearing pin
8 First end of 1
9 Second end of 1
10 Valve stem support
10*a* Valve stem support surface
10*b* Plane

11 Groove
12 Guide wall
13 Guide wall
11 Support wall
15 Transition
16 Transition
16*a* Plane
17 Free space
18 Free space
19 End of side wall 1
20 End of side wall 5
21 Gap
22 Gap
23 Blank
24 Roller pocket
25 Channel
26 Channel
R Inner radius
$R_R$ Unshaped part radius of 25 and 26
A Distance between 10*b* and 16*a*
B Width of 17 and 18

The invention claimed is:

1. A cam follower for a valve train of an internal combustion engine, comprising viewed in cross section, a U-shaped lever made from sheet steel in a non-cutting process including a base wall and side walls extending from said base wall, wherein a valve stem support formed as a groove is provided on one end of the lever in a surface of the base wall facing away from the side walls, the valve stem support includes side guide walls formed by a non-cutting shaping process extending from and counter to the side walls and are connected to a support wall forming a valve stem support surface, the valve stem support surface extends in a first plane that is spaced apart from a second plane extending through an inner transition between the side walls and the adjacent guide walls in a direction of free ends of the side walls, at the transition, an inner radius R is provided by which a free space is created between each of the side walls, and the guide walls and said free space narrows in the direction of the free end of the respective side wall, wherein the inner radius R and the free space are formed as a common indentation in the inner transition, in the side wall, and in the guide wall.

2. The cam follower according to claim 1, wherein the respective free space narrows up to a contact of the respective guide wall on the respective side wall.

3. The cam follower according to claim 1, wherein the free space has, in an area in which the inner radius R connects, a width B of ≥0.6 mm and the inner radius R≥0.3 mm.

4. The cam follower according to claim 1, wherein the free space has a droplet-shaped contour.

5. The cam follower according to claim 1, wherein the lever is constructed as a rocker arm or finger lever provided with a roller pocket for a cam roller.

6. A cam follower for a valve train of an internal combustion engine, comprising viewed in cross section, a U-shaped lever made from sheet steel in a non-cutting process including a base wall and side walls extending from said base wall, wherein a valve stem support formed as a groove is provided on one end of the lever in a surface of the base wall facing away from the side walls, the valve stem support includes side guide walls formed by a non-cutting shaping process extending from and counter to the side walls and are connected to a support wall forming a valve stem support surface, the valve stem support surface extends in a first plane that is spaced apart from a second plane extending through an inner transition between the side walls and the adjacent guide walls in a direction of free ends of the side walls, at the transition, an inner radius R is provided by which a free space is created between each of the side walls, and the guide walls and said free space narrows in the direction of the free end of the respective side wall, wherein the respective free space opens into a gap between the side wall and the guide wall, and the free space has, in an area in which the inner radius R connects, a maximum width that is at least 5 times a width of the gap.

7. A method for the non-cutting production of a cam follower comprising a lever formed from sheet steel, said lever is provided for a valve train of an internal combustion engine and being formed with an essentially a U-shaped cross section with a base wall and side walls extending essentially perpendicular to the base wall, and a valve stem support provided on one end of the lever is formed as a groove in the base wall, having side guiding walls formed by a non-cutting shaping process, starting from the side walls, extending opposite to said walls, and are connected to a support wall forming a valve stem support surface, the valve stem support surface extending in a first plane that is spaced apart to a second plane extending through an inner transition between the side walls and the adjacent guiding walls in the direction of free ends of the side walls the method comprising in a first processing step, punching a blank out from the sheet steel, in a second processing step, embossing two grooves with a blank radius $R_R$ in a longitudinal direction of the blank in a surface of the blank, shaping the blank in a third processing step for the production of said U-shape, and in a fourth processing step, embossing the groove in the base wall, creating a transition from each of the side walls to the base wall at the two grooves, wherein, due to the embossed blank radius $R_R$, said transition is formed with an inner radius R and a free space that has a drop-shaped contour, viewed in a cross section of the lever.

* * * * *